US009367004B2

(12) United States Patent
Naruse et al.

(10) Patent No.: US 9,367,004 B2
(45) Date of Patent: Jun. 14, 2016

(54) ABNORMALITY DETECTION METHOD AND ABNORMALITY DETECTION DEVICE FOR IMAGE FORMING APPARATUS, AND IMAGE FORMING APPARATUS

(71) Applicant: KYOCERA DOCUMENT SOLUTIONS INC., Osaka (JP)

(72) Inventors: Kentaro Naruse, Osaka (JP); Ryo Kawaoka, Osaka (JP); Junya Yoda, osaka (JP); Rie Tezuka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 28 days.

(21) Appl. No.: 14/188,476

(22) Filed: Feb. 24, 2014

(65) Prior Publication Data

US 2014/0241740 A1 Aug. 28, 2014

(30) Foreign Application Priority Data

Feb. 25, 2013 (JP) ..... 2013-034955

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/55* (2013.01); *G03G 2215/2032* (2013.01)

(58) Field of Classification Search
CPC ..... G03G 15/2053
See application file for complete search history.

(56) References Cited

U.S. PATENT DOCUMENTS

2007/0065165 A1* 3/2007 Mashiba ..... 399/33
2007/0108191 A1* 5/2007 Takagi et al. ..... 219/619
2011/0274446 A1* 11/2011 Fukushi ..... 399/22
2012/0045226 A1* 2/2012 Hase et al. ..... 399/33
2013/0136480 A1* 5/2013 Hasegawa ..... 399/69

FOREIGN PATENT DOCUMENTS

JP 2011-113006 A 6/2011
JP 2011164245 A * 8/2011

OTHER PUBLICATIONS

Machine translation of JPO document, Aoki (JP2011164245A); "Fixing Device, Control Method for the Same, Image Forming Apparatus Including Them, and Image Forming Method"; by Aoki, Koji; published Aug. 25, 2011.*

* cited by examiner

*Primary Examiner* — David Gray
*Assistant Examiner* — Geoffrey Evans
(74) *Attorney, Agent, or Firm* — Studebaker & Brackett PC

(57) ABSTRACT

An abnormality detection device for an image forming apparatus detects an abnormality in the image forming apparatus which includes a heating belt looped around a heating roller and a fixing roller. The abnormality detection device for an image forming apparatus includes: thermistors for detecting temperatures of one widthwise end portion and the other widthwise end portion of the heating belt; a temperature difference detection section for determining whether or not a temperature difference between the temperature of the one end portion and the temperature of the other end portion which are detected by the thermistors is greater than a predetermined value; and a judgment section for judging that an abnormality has occurred in the image forming apparatus when it is determined in the temperature difference detection section that the temperature difference is greater than the predetermined value.

14 Claims, 6 Drawing Sheets

ABNORMALITY DETECTION METHOD AND ABNORMALITY DETECTION DEVICE FOR IMAGE FORMING APPARATUS, AND IMAGE FORMING APPARATUS

INCORPORATION BY REFERENCE

The present application claims priority under 35 U.S.C. §119 to Japanese Patent Application No. 2013-034955, filed Feb. 25, 2013. The contents of this application are incorporated herein by reference in their entirety.

BACKGROUND

The present disclosure relates to an abnormality detection method and an abnormality detection device for an image forming apparatus and to an image forming apparatus, and particularly relates to a method for detecting breakage or positional deviation in a heating belt.

As a fixing unit for use in an electrophotographic image forming apparatus, a thermal belt fixing unit has been known. In the thermal belt fixing unit, a heating belt is looped around a heating roller and a fixing roller. However, in the thermal belt fixing unit, when the heating belt meanders, there is a probability that an abnormality, such as formation of wrinkles in the heating belt, occurs.

In view of the above, a method for judging an abnormality in a fixing belt (heating belt) using a temperature sensor, for example, has been proposed. In such a method, the temperature sensor is provided at an end portion of the heating belt. When the temperature detected by the temperature sensor temporarily decreases, it is determined whether or not the decrease of the temperature is greater than a reference temperature decrease. When decrease of the temperature which is greater than the reference temperature decrease periodically occurs multiple times, it is determined that the heating belt has deformed.

SUMMARY

An abnormality detection method for an image forming apparatus of the present disclosure is configured to detect an abnormality in an image forming apparatus which includes a heating belt looped around a heating roller and a fixing roller. The abnormality detection method for an image forming apparatus of the present disclosure includes: a temperature detection step of detecting temperatures of one widthwise end portion and the other widthwise end portion of the heating belt using thermistors; a temperature difference detection step of determining whether or not a temperature difference between the temperature of the one end portion and the temperature of the other end portion which are detected in the temperature detection step is greater than a predetermined value; and a judgment step of judging that an abnormality has occurred in the image forming apparatus when it is determined in the temperature difference detection step that the temperature difference is greater than the predetermined value.

An abnormality detection device for an image forming apparatus of the present disclosure detects an abnormality in the image forming apparatus which includes a heating belt looped around a heating roller and a fixing roller. The abnormality detection device for an image forming apparatus of the present disclosure includes: thermistors for detecting temperatures of one widthwise end portion and the other widthwise end portion of the heating belt; a temperature difference detection section for determining whether or not a temperature difference between the temperature of the one end portion and the temperature of the other end portion which are detected by the thermistors is greater than a predetermined value; and a judgment section for judging that an abnormality has occurred in the image forming apparatus when it is determined in the temperature difference detection section that the temperature difference is greater than the predetermined value.

An image forming apparatus of the present disclosure includes the above-described abnormality detection device for the image forming apparatus.

DETAILED DESCRIPTION

Hereinafter, a configuration of an image forming apparatus 1 according to an embodiment of the present disclosure is described with reference to FIG. 1.

Figure 1:
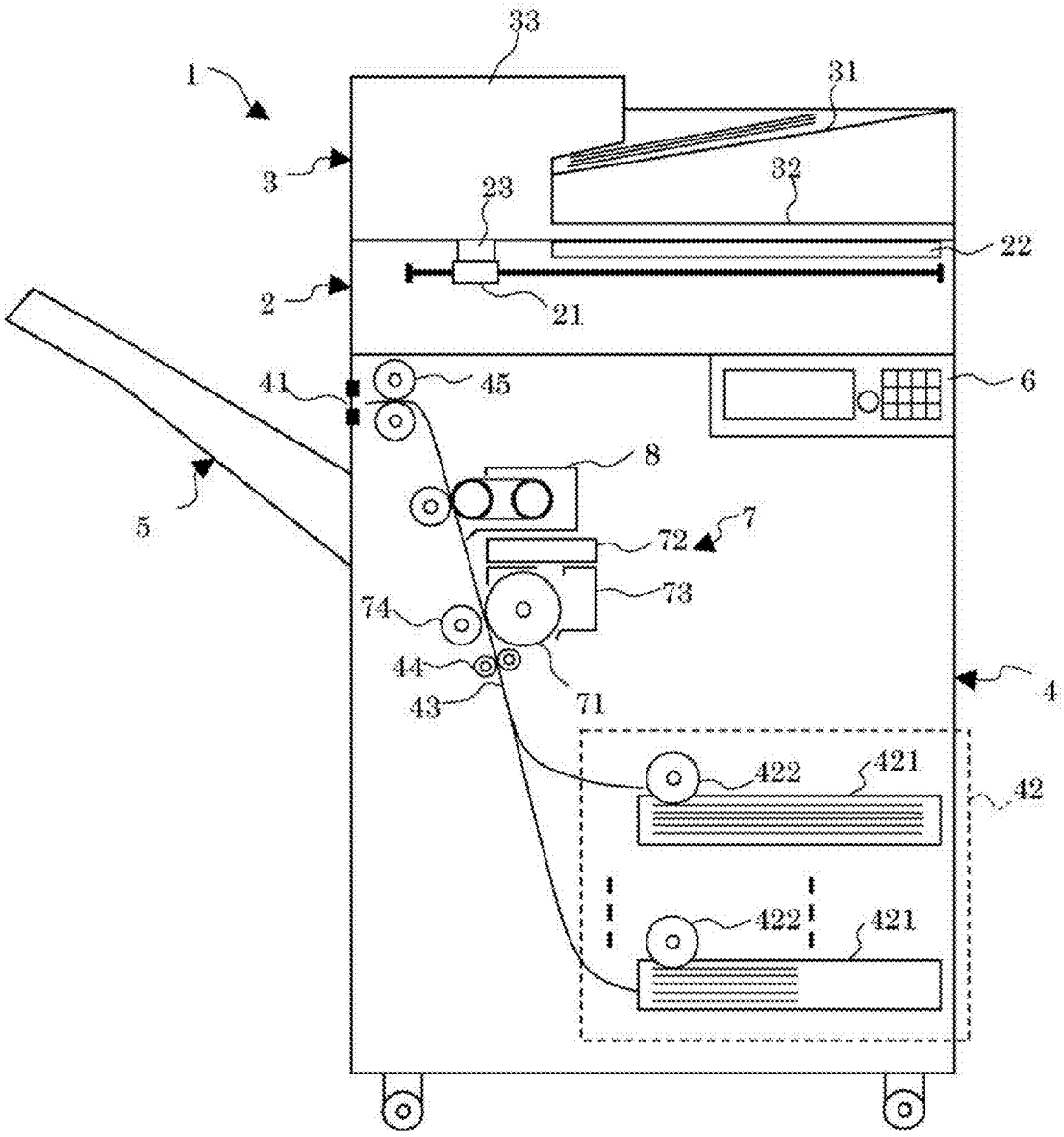
FIG. 1 is a diagram showing a configuration of an image forming apparatus according to an embodiment of the present disclosure.

As shown in FIG. 1, the image forming apparatus 1 of the present embodiment includes a reading section 2, a feeding section 3, a main body section 4, a stack tray 5, and a control panel section (input section) 6.

The reading section 2 is provided on the main body section 4. The feeding section 3 is provided on the reading section 2. The stack tray 5 is provided at a side surface of the main body section 4 (on the exit port 41 side). The control panel section 6 is provided on the front surface of the main body section 4.

The reading section 2 includes a scanner 21 and a platen glass 22. The reading section 2 has a reading slit 23.

The scanner 21 includes an exposure lamp, an imaging sensor, etc. Preferred examples of the imaging sensor include CCD (Charge Coupled Device) and CMOS (Complementary Metal Oxide Semiconductor) sensors.

An original document is conveyed (fed) by the feeding section 3 in a predetermined direction (hereinafter, "feeding direction"). The scanner 21 can be moved in the feeding direction. The platen glass 22 is a transparent copy holder. The reading slit 23 is a slit extending in a direction perpendicular to the feeding direction.

In the case of reading an original document placed on the platen glass 22, the scanner 21 is moved to a position so as to oppose the platen glass 22. Then, the scanner 21 scans the original document placed on the platen glass 22 to read the original document. Thereby, the scanner 21 obtains image data. Then, the scanner 21 outputs the obtained image data to the main body section 4.

In the case of reading an original document conveyed by the feeding section 3, the scanner 21 is moved to a position so as to oppose the reading slit 23. Then, the scanner 21 reads the original document via the reading slit 23 in synchronization with the conveyance operation of the feeding section 3. Thereby, the scanner 21 obtains image data. Then, the scanner 21 outputs the obtained image data to the main body section 4.

The feeding section 3 includes a placement section 31, an exit section 32, and a conveyance mechanism 33.

The original document is placed on the placement section 31. Then, the original document placed on the placement section 31 is sequentially conveyed on a sheet-by-sheet basis by the conveyance mechanism 33 to a position so as to oppose the reading slit 23. Thereafter, the original document is ejected to the exit section 32. Note that the feeding section 3 is turnable. By turning the feeding section 3 upward, the upper surface of the platen glass 22 can be exposed.

The main body section 4 includes an image forming section 7, a paper feeding section 42, a conveyance path 43, a conveyance roller pair 44, and an ejection roller pair 45. A side surface of the main body section 4 has an exit port 41.

The paper feeding section 42 includes a plurality of paper feed cassettes 421 and paper feed rollers 422 which are provided for respective ones of the paper feed cassettes 421. The plurality of paper feed cassettes 421 each contain sheets of paper (recording paper). The size or orientation of the contained paper varies among the paper feed cassettes 421, for example. The paper feed rollers 422 send the paper off from the paper feed cassettes 421 to the conveyance path 43 on a sheet-by-sheet basis.

The paper sent off to the conveyance path 43 is conveyed by the conveyance section. In the present embodiment, the paper feed rollers 422, the conveyance roller pair 44, and the ejection roller pair 45 function as the conveyance section. The paper sent off to the conveyance path 43 is conveyed by the conveyance roller pair 44 to the image forming section 7.

The image forming section 7 carries out recording on the paper based on predetermined image data. Thereafter, the recorded paper is conveyed by the ejection roller pair 45 and ejected to the stack tray 5 via the exit port 41.

The control panel section 6 includes a display section and an input section. The display section is realized by a LCD (Liquid Crystal Display), for example. The input section includes buttons for entering an instruction regarding printing, sending, receiving, storing, or recording (e.g., a start key or numeric keypad) and buttons for switching the operation mode (e.g., copying/FAX sending/scanner). The control panel section 6 may be realized by a touch panel in which the display section and the input section are integrated.

The control panel section 6 receives an instruction (entry) from a user. The user can assign various jobs to the image forming apparatus 1 via the control panel section 6. In the case where an instruction of a user is to be permitted based on authentication of that user, the control panel section 6 receives an entry for the authentication (e.g., an entry of a password).

The image forming section 7 includes a photosensitive drum 71, an exposure section 72, a development section 73, a transfer section 74, and a fixing unit 8. The exposure section 72 is, for example, an optical unit which includes a laser device, a mirror, and a lens. The exposure section 72 emits light according to image data to irradiate the photosensitive drum 71 (i.e., expose the photosensitive drum 71 to the light). Thereby, an electrostatic latent image is formed on the surface of the photosensitive drum 71. The development section 73 is a development unit for developing the electrostatic latent image formed on the photosensitive drum 71 using a toner. As a result, a toner image which is according to the electrostatic latent image is formed on the photosensitive drum 71.

The transfer section 74 transfers the toner image formed on the photosensitive drum 71 to the paper (recording paper). The fixing unit 8 heats the paper to which the toner image has been transferred. Thereby, the toner image is fixed to the paper.

Figure 2:
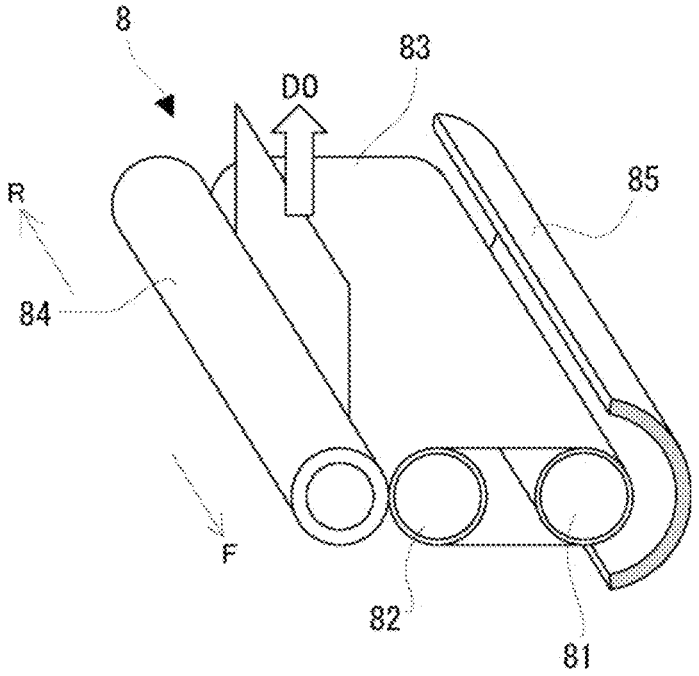
FIG. 2 is a diagram showing a configuration of a fixing unit included in the image forming apparatus shown in FIG. 1.

Hereinafter, a configuration of the fixing unit 8 is described mainly with reference to FIG. 2. FIG. 2 shows a general configuration of the fixing unit 8. In FIG. 2, arrow D0 represents the conveyance direction of the paper (recording paper).

The fixing unit 8 includes a heating roller 81, a fixing roller 82, a heating belt 83, a pressure roller 84, and a heat source 85. The heating belt 83 is a belt for fixing the toner to the paper. The heating belt 83 is looped around the heating roller 81 and the fixing roller 82. The pressure roller 84 is a roller for pressing the paper against the heating belt 83. The pressure roller 84 is in contact with the heating belt 83. The heat source 85 is a source of heat for heating the heating belt 83. The heat source 85 is provided around the heating roller 81 with a space between the heat source 85 and the heating roller 81.

The heating roller 81 includes, for example, an iron base and a mold release layer formed on the outer peripheral surface of the iron base. The iron base has a shape of a hollow cylinder, for example. The mold release layer is, for example, a PFA (tetra fluoro ethylene perfluoroalkyl vinyl ether copolymer) layer which has a thickness of not less than 0.2 mm and not more than 1.0 mm. The heating roller 81 has a shape of a hollow cylinder whose outside diameter is 30 mm, for example.

The fixing roller 82 includes, for example, a core bar and a sponge layer covering the outer peripheral surface of the core bar. The core bar is made of, for example, stainless steel having an outside diameter of 45 mm. The sponge layer is made of, for example, silicone rubber having a thickness of not less than 5 mm and not more than 10 mm. The fixing roller 82 has a shape of a hollow cylinder, for example.

The heating belt 83 includes, for example, a nickel electroformed base, a silicone rubber layer formed on the nickel electroformed base, and a mold release layer (e.g., PFA layer) formed on the silicone rubber layer. The nickel electroformed base has a thickness of not less than about 30 μm and not more than about 50 μm. The heating belt 83 heats paper (recording paper), for example.

The pressure roller 84 includes, for example, a core bar, a sponge layer covering the outer peripheral surface of the core bar, and a mold release layer. The core bar is made of stainless steel. The sponge layer is made of, for example, silicone rubber having a thickness of not less than 2 mm and not more than 5 mm. The mold release layer is, for example, a PFA layer. The pressure roller 84 has a shape of a solid cylinder whose outside diameter is 50 mm, for example. The core member of the pressure roller 84 may be made of a metal, such as Fe or Al. The silicone rubber layer may be formed on the core member of the pressure roller 84. Further, a fluorine resin layer may be formed over the surface of the silicone rubber layer.

The heat source 85 is an induction heating device which utilizes electromagnetic induction. The heat source 85 includes a magnetizing coil, etc. The heat source 85 heats the heating roller 81 and the heating belt 83 by means of induction heating.

Figure 3:
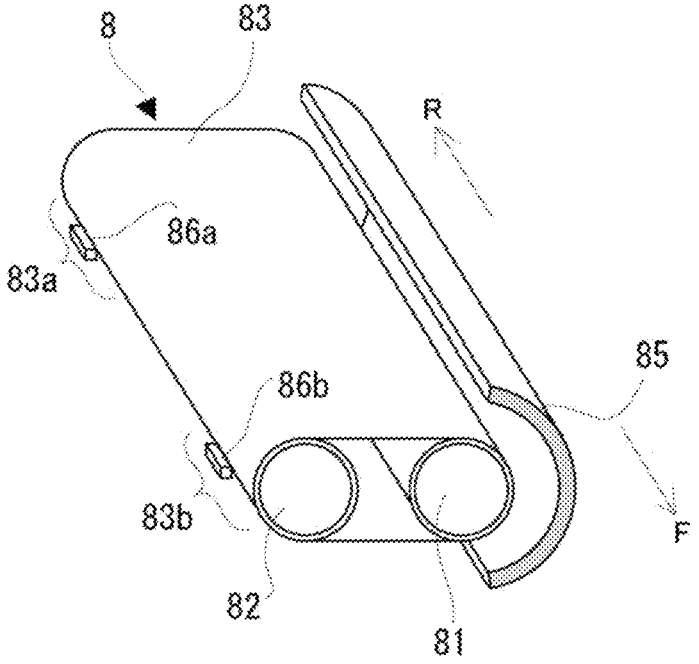
FIG. 3 is a diagram showing positions to which thermistors included in the fixing unit shown in FIG. 1 are attached.

The fixing unit 8 further includes thermistors 86*a* and 86*b*. FIG. 3 shows the arrangement of the thermistors 86*a*, 86*b*. The R (rear) side widthwise end portion 83*a* of the heating belt 83 is provided with the R-side end portion thermistor 86*a* for temperature detection. The F (front) side widthwise end portion 83*b* of the heating belt 83 is provided with the F-side end portion thermistor 86*b* for temperature detection. Note that the detection positions of the thermistors 86*a*, 86*b* may be determined such that a temperature difference detection circuit 87*a* (see FIG. 4), which will be described later, can detect occurrence of an abnormality (particularly, breakage or positional deviation) in the heating belt 83 based on the detected temperatures of the thermistors 86*a*, 86*b*. Respective output signals (detection results) from the R-side end portion thermistor 86*a* and the F-side end portion thermistor 86*b* are used for, for example, control of the heating temperature (the amount of heat from the heat source 85) or detection of an abnormality (particularly, breakage or positional deviation) in the heating belt 83 (detection by the temperature difference detection circuit 87*a* (see FIG. 4)).

Figure 4:
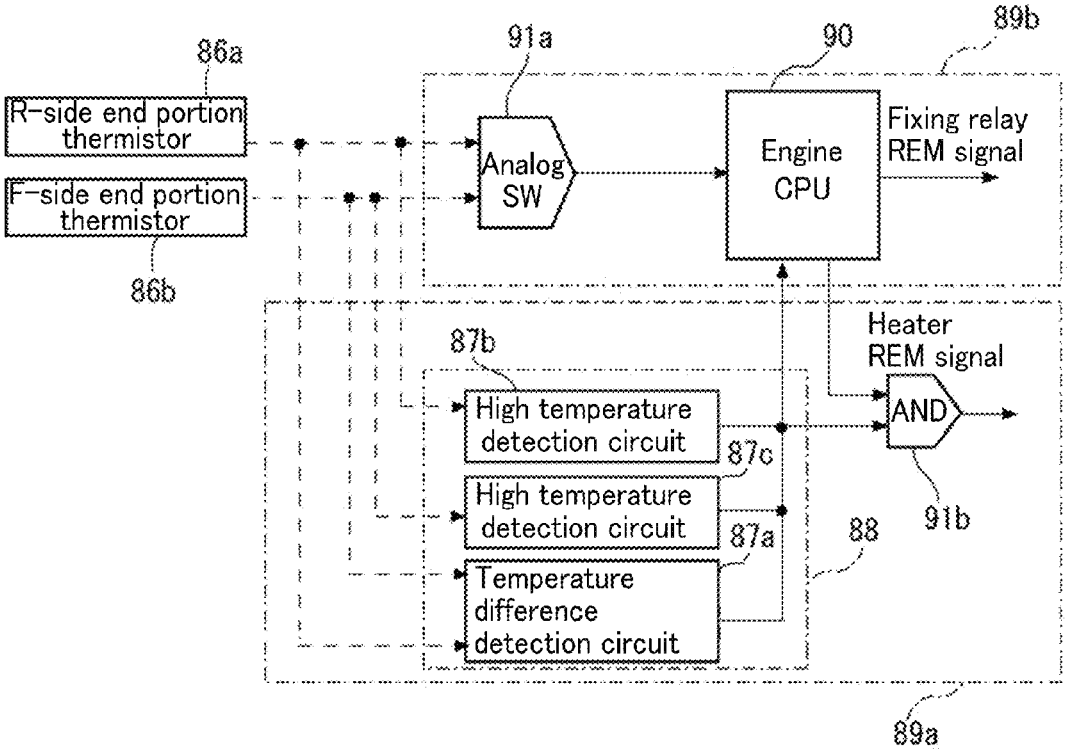
FIG. 4 is a block diagram showing a configuration of a comparison board and an engine board included in the image forming apparatus shown in FIG. 1.

The image forming apparatus 1 further includes a comparison board 89*a* and an engine board 89*b* as shown in FIG. 4. Hereinafter, the respective configurations of the comparison board 89*a* and the engine board 89*b* are described mainly with reference to FIG. 4. FIG. 4 is a block diagram showing a general configuration of the comparison board 89*a* and the engine board 89*b*.

The comparison board 89*a* includes the temperature difference detection circuit 87*a*. The temperature difference detection circuit 87*a* is a circuit which obtains the temperature difference between the end portion 83*a* and the end portion 83*b* based on the temperatures respectively detected by the R-side end portion thermistor 86*a* and the F-side end portion thermistor 86*b*, and determines whether or not the temperature difference is greater than a predetermined value. During a normal operation of the fixing unit 8, the temperature difference detection circuit 87*a* transmits a rotation pulse signal (see line L14 which will be described later in FIG. 6). When occurrence of breakage or positional deviation in the heating belt 83 is detected during the operation of the fixing unit 8, the temperature difference detection circuit 87*a* transmits a low level signal (see line L14 which will be described later in FIG. 6).

Further, the comparison board 89*a* includes high temperature detection circuits 87*b* and 87*c*. The high temperature detection circuit 87*b* determines whether or not the temperature of the end portion 83*a* has reached a predetermined temperature (high temperature) based on the output signal (detection result) of the R-side end portion thermistor 86*a*. The high temperature detection circuit 87*c* determines whether or not the temperature of the end portion 83*b* has reached a predetermined temperature (high temperature) based on the output signal (detection result) of the F-side end portion thermistor 86*b*. The high temperature detection circuits 87*b*, 87*c* each output a high level signal during the normal operation of the fixing unit 8 and output a low level signal when an abnormality is detected.

The temperature difference detection circuit 87*a* and the high temperature detection circuits 87*b*, 87*c* constitute a wired OR circuit 88. Specifically, the respective output lines of the temperature difference detection circuit 87*a* and the high temperature detection circuits 87*b*, 87*c* connected in parallel to one another. The output signal of the wired OR circuit 88 is input to an engine CPU 90 and an AND circuit 91*b*. The engine CPU 90 is, for example, mounted onto the engine board 89*b* and controls the operation of the image forming apparatus 1.

When none of the circuits 87*a*, 87*b*, and 87*c* outputs a low level signal (when a rotation pulse signal and a high level signal are output), a rotation pulse signal is output from the wired OR circuit 88. As a result, the rotation pulse signal is input to the engine CPU 90 and the AND circuit 91*b*. On the other hand, when a low level signal is output from any of the circuits 87*a*, 87*b*, and 87*c*, the low level signal is output from the wired OR circuit 88. As a result, the low level signal is input to the engine CPU 90 and the AND circuit 91*b*.

In addition to the above-described output signal of the wired OR circuit 88 (hereinafter, "first temperature signal"), an output signal of an analog switch (analog SW) 91*a* (hereinafter, "second temperature signal") is input to the engine CPU 90. Respective output signals of the R-side end portion thermistor 86*a* and the F-side end portion thermistor 86*b* are input to the analog switch 91*a*. The second temperature signal is output from the analog switch 91*a*.

The engine CPU 90 generates a signal for controlling the operation of the fixing unit 8 (hereinafter, "fixing relay REM signal") and a signal for controlling the temperature of the heat source 85 (hereinafter, "heater REM signal") based on the first temperature signal and the second temperature signal, and outputs the generated signals. The fixing relay REM signal is input to the fixing unit 8. The heater REM signal is input to the heat source 85 via the AND circuit 91*b*.

When the signal output from the wired OR circuit 88 to the AND circuit 91*b* is a rotation pulse signal, the AND circuit 91*b* outputs an input signal (heater REM signal), as it is, from the engine CPU 90 to the heat source 85. On the other hand, when the signal output from the wired OR circuit 88 to the AND circuit 91*b* is a low level signal, the AND circuit 91*b* does not output (stops outputting) the heater REM signal to the heat source 85.

Figure 5:
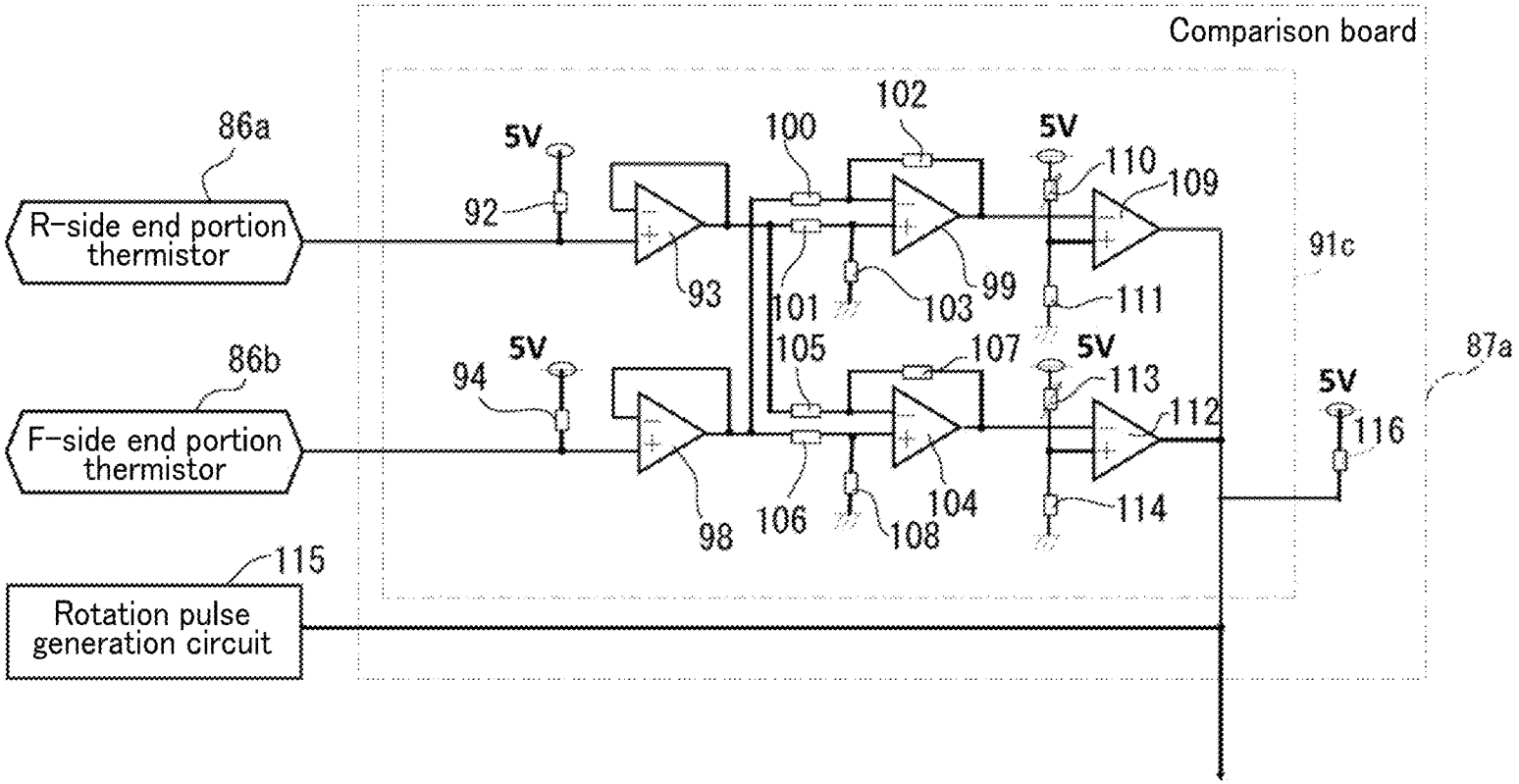
FIG. 5 is a circuit diagram showing a configuration of a temperature difference detection circuit included in the comparison board shown in FIG. 4.

The temperature difference detection circuit 87*a* includes a differential amplifier circuit 91*c* such as shown in FIG. 5. Hereinafter, a configuration of the differential amplifier circuit 91*c* is described mainly with reference to FIG. 5. FIG. 5 is a circuit diagram showing an example of the differential amplifier circuit 91*c*.

A resistance element 92 is connected in series to the R-side end portion thermistor 86*a*. The output line of the R-side end portion thermistor 86*a* is electrically connected to a non-inverting input terminal (+) of an operational amplifier 93. The output terminal of the operational amplifier 93 is electrically connected to an inverting input terminal (−) of the operational amplifier 93. The operational amplifier 93 constitutes a voltage follower circuit.

A resistance element 94 is connected in series to the F-side end portion thermistor 86*b*. The output line of the F-side end portion thermistor 86*b* is electrically connected to a non-inverting input terminal (+) of an operational amplifier 98. The output terminal of the operational amplifier 98 is electrically connected to an inverting input terminal (−) of the operational amplifier 98. The operational amplifier 98 constitutes a voltage follower circuit.

An operational amplifier 99 and resistance elements 100 to 103 constitute a differential amplifier circuit (hereinafter, "first differential amplifier circuit"). The output signal of the operational amplifier 93 (hereinafter, "sensor output Vc") is input to the first differential amplifier circuit. Specifically, the sensor output Vc is input to a non-inverting input terminal (+) of the operational amplifier 99 via the resistance element 101. The sensor output Vc is also input to an inverting input terminal (−) of an operational amplifier 104 via a resistance element 105. The non-inverting input terminal (+) of the operational amplifier 99 is grounded via the resistance element 103.

The operational amplifier 104 and resistance elements 105 to 108 constitute a differential amplifier circuit (hereinafter, "second differential amplifier circuit"). The output signal of the operational amplifier 98 (hereinafter, "sensor output Ve") is input to the second differential amplifier circuit. Specifically, the sensor output Ve is input to a non-inverting input terminal (+) of the operational amplifier 104 via the resistance element 106. The sensor output Ve is also input to an inverting input terminal (−) of the operational amplifier 99 via a resistance element 100. The non-inverting input terminal (+) of the operational amplifier 104 is grounded via the resistance element 108.

Each of the resistance elements 100 and 101 has a resistance value of, for example, 10 kΩ. Each of the resistance elements 102 and 103 has a resistance value of, for example, 100 kΩ. The output from the first differential amplifier circuit is a voltage which is obtained by amplifying the difference value between the sensor voltage (sensor output Vc) and the compensation voltage (sensor output Ve), i.e., Vc−Ve, by a factor of 10 (hereinafter, "first amplified voltage"). The first differential amplifier circuit detects the first temperature difference that is obtained by subtracting the temperature of the other widthwise end portion (end portion 83*b*) of the heating belt 83 from the temperature of one widthwise end portion (end portion 83*a*). The first amplified voltage corresponds to the first temperature difference.

Each of the resistance elements 105 and 106 has a resistance value of, for example, 10 kΩ. Each of the resistance elements 107 and 108 has a resistance value of, for example, 100 kΩ. The output from the second differential amplifier circuit is a voltage which is obtained by amplifying the difference value between the sensor voltage (sensor output Ve) and the compensation voltage (sensor output Vc), i.e., Ve−Vc, by a factor of 10 (hereinafter, "second amplified voltage"). The second differential amplifier circuit detects the second temperature difference that is obtained by subtracting the temperature of one widthwise end portion (end portion 83*a*) of the heating belt 83 from the temperature of the other widthwise end portion (end portion 83*b*). The second amplified voltage corresponds to the second temperature difference.

The output signal of the operational amplifier 99 (first amplified voltage) is input to one of the input terminals of a comparator 109. The other input terminal of the comparator 109 receives a voltage signal which is determined based on the respective resistance values of the resistance elements 110 and 111 (threshold value V1). For example, in order to set the threshold value V1 to 2.5 V, the supply voltage of 5 V may be divided by the resistance elements 110, 111 that have the same resistance values. When the first amplified voltage is greater than the threshold value V1, the comparator 109 outputs a low level signal (ON determination). When the first amplified voltage is smaller than the threshold value V1, the comparator 109 outputs a high level signal (OFF determination). In the present embodiment, the comparator 109 corresponds to the first comparator. The comparator 109 determines whether or not the first temperature difference is greater than the first predetermined value (threshold value V1).

The output signal of the operational amplifier 104 (second amplified voltage) is input to one of the input terminals of a comparator 112. The other input terminal of the comparator 112 receives a voltage signal which is determined based on the respective resistance values of the resistance elements 113 and 114 (threshold value V2). For example, in order to set the threshold value V2 to 2.5 V, the supply voltage of 5 V may be divided by the resistance elements 113, 114 that have the same resistance values. When the second amplified voltage is greater than the threshold value V2, the comparator 112 outputs a low level signal (ON determination). When the second amplified voltage is smaller than the threshold value V2, the comparator 112 outputs a high level signal (OFF determination). In the present embodiment, the comparator 112 corresponds to the second comparator. The comparator 112 determines whether or not the second temperature difference is greater than the second predetermined value (threshold value V2).

The respective supply voltage values shown in FIG. 5 can be changed to values which are suitable for detection of breakage or positional deviation in the heating belt 83. The threshold value V1 and the threshold value V2 may be equal to each other or may be different from each other.

The respective output lines of the comparators 109, 112 are electrically connected to a rotation pulse generation circuit 115. Each of the outputs of the comparators 109, 112 and the rotation pulse generation circuit 115 is an open collector type output. The comparators 109, 112 and the rotation pulse generation circuit 115 constitute a wired OR circuit. A resistance element 116 functions as a pull-up resistance. When a rotation pulse is output from the rotation pulse generation circuit 115 while high level signals are output from both the comparators 109, 112, the wired OR circuit outputs a rotation pulse signal (see line L14 which will be described later in FIG. 6).

Figure 6:
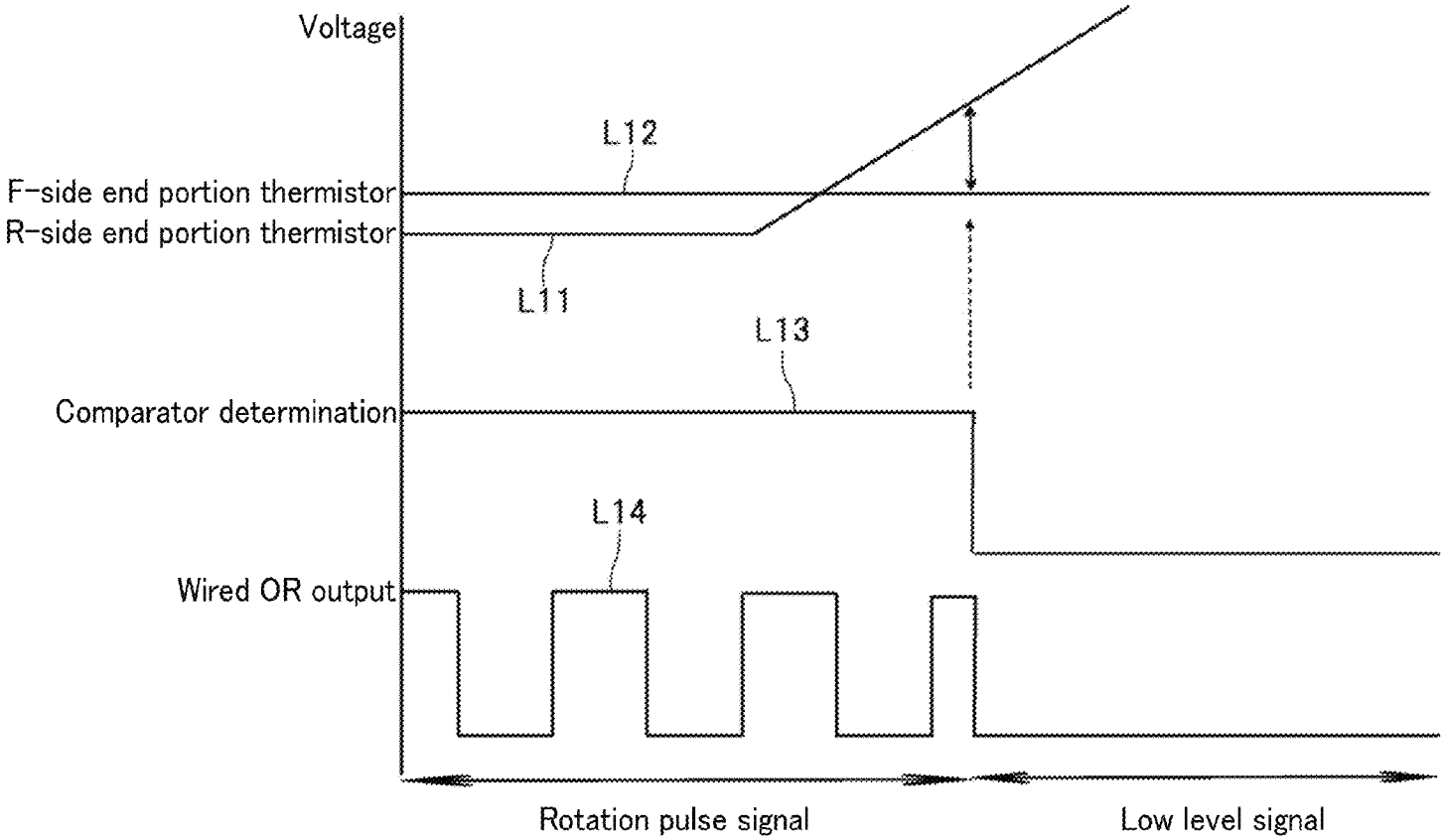
FIG. 6 is a graph showing the transition of the respective output voltages of an R-side end portion thermistor, an F-side end portion thermistor, a comparator, and a wired OR circuit.
Figure 7A:
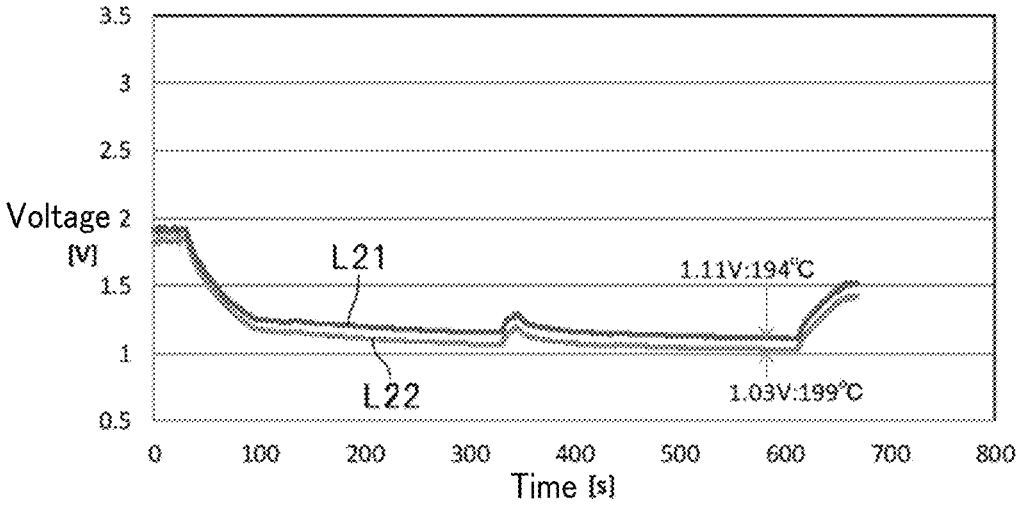
FIG. 7A is a graph showing the transition of the respective output voltages of the R-side end portion thermistor and the F-side end portion thermistor in the case where the image forming apparatus is in a normal state.
Figure 7B:
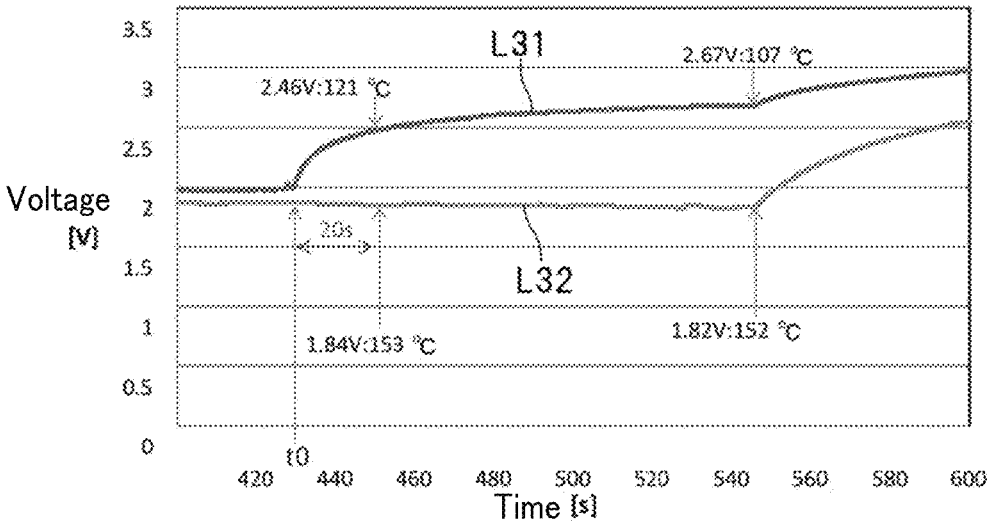
FIG. 7B is a graph showing the transition of the respective output voltages of the R-side end portion thermistor and the F-side end portion thermistor in the case where an abnormality occurs in the image forming apparatus.

Now, a method for detecting breakage or positional deviation in the heating belt 83 using the differential amplifier circuit 91*c* is described with reference to FIG. 6, FIG. 7A, and FIG. 7B. In FIG. 6, line L11 represents the output voltage of the R-side end portion thermistor 86*a*, line L12 represents the output voltage of the F-side end portion thermistor 86*b*, line L13 represents the output voltage of the comparator, and line L14 represents the output voltage of the wired OR circuit. In FIG. 7A, line L21 represents the output voltage of the R-side end portion thermistor 86*a*, and line L22 represents the output voltage of the F-side end portion thermistor 86*b*. In FIG. 7B, line L31 represents the output voltage of the R-side end portion thermistor 86*a*, and line L32 represents the output voltage of the F-side end portion thermistor 86*b*.

The fixing unit 8 fixes the toner to the paper. In this fixing process, the heating belt 83 is heated by the heat source 85. When the paper is supplied between the heating belt 83 and the pressure roller 84, each of the temperatures detected by the R-side end portion thermistor 86*a* and the F-side end portion thermistor 86*b* is maintained constant. While the fixing process is normally carried out, each of the temperatures detected by the R-side end portion thermistor 86*a* and the F-side end portion thermistor 86*b* is maintained constant.

When there is no breakage or positional deviation in the heating belt 83 (normal state), the difference value between the output voltage of the R-side end portion thermistor 86*a* and the output voltage of the F-side end portion thermistor 86*b* (hence, the difference value between the sensor output Vc and the sensor output Ve) is small as represented by line L11 and line L12 in FIG. 6. The output value of the operational amplifier 99 is smaller than the threshold value V1 of the comparator 109. The output value of the operational amplifier 104 is smaller than the threshold value V2 of the comparator 112. Thus, as represented by line L13 in FIG. 6, the determination by each of the comparators 109 and 112 is OFF determination (so that each comparator outputs a high level signal). As a result, as represented by line L14 in FIG. 6, the wired OR circuit outputs a rotation pulse signal according to the output of the rotation pulse generation circuit 115.

On the other hand, when there is breakage or positional deviation (abnormality) in the heating belt 83, there is a portion of the heating belt 83 in which the temperature is not detected (or unlikely to be detected) by the R-side end portion thermistor 86*a* or the F-side end portion thermistor 86*b*. If such a portion traverses a position to which the R-side end portion thermistor 86*a* or the F-side end portion thermistor 86*b* is attached, the temperature detected by any of the R-side end portion thermistor 86*a* and the F-side end portion thermistor 86*b* is lower than the temperature detected in the normal state. And, as represented by line L11 in FIG. 6, the output voltage of one of the R-side end portion thermistor 86*a* and the F-side end portion thermistor 86*b* at which the detected temperature has decreased (e.g., the R-side end portion thermistor 86*a*) increases. As a result, the difference value between the output voltage of the R-side end portion thermistor 86*a* and the output voltage of the F-side end portion thermistor 86*b* (hence, the difference value between the sensor output Vc and the sensor output Ve) increases.

When the difference value between the sensor output Vc and the sensor output Ve increases and the output of any one of the operational amplifiers 99 and 104 is greater than the voltage signal of a predetermined value (threshold value V1 or V2), any of the comparators 109 and 112 makes the ON determination as represented by line L13 in FIG. 6. As a result, as represented by line L14 in FIG. 6. a low level signal is output from the wired OR circuit.

Data of copying of 500 sheets of A4-size copy paper with the use of an image forming apparatus designed for 100 V power supply at the copying rate of 60 sheets per minute in such a manner that the copy paper was conveyed with its short side being oriented toward the conveyance direction are shown in FIG. 7A. For example, when there is no breakage or positional deviation in the heating belt 83, i.e., when the heating belt 83 is in a normal state, the detected temperature of the R-side end portion thermistor 86*a* (e.g., about 194° C.) is generally equal to the detected temperature of the F-side end portion thermistor 86*b* (e.g., about 199° C.). In this case, the output voltage of the R-side end portion thermistor 86*a* (see line L21 in FIG. 7A) is about 1.11 V, for example, and the output voltage of the F-side end portion thermistor 86*b* (see line L22 in FIG. 7A) is about 1.03 V, for example. The temperature difference between the temperature of one end portion (end portion 83*a*) which is detected by the R-side end portion thermistor 86*a* and the temperature of the other end portion (end portion 83*b*) which is detected by the F-side end portion thermistor 86*b* is small. Therefore, both the comparators 109 and 112 make the OFF determination, so that a rotation pulse signal is output from the wired OR circuit.

On the other hand, for example, when at timing t0 in FIG. 7B breakage occurs in the end portion 83*a* of the heating belt 83 and the detected temperature of the R-side end portion thermistor 86*a* rapidly decreases to about 121° C. in about 20 seconds, the output voltage of the R-side end portion thermistor 86*a* (see line L31 in FIG. 7B) increases from about 2 V to about 2.46 V. The estimated temperature of the iron base of the heating roller 81 at the broken portion of the heating belt 83 is 370° C. Thereafter, the detected temperature of the R-side end portion thermistor 86*a* moderately decreases to about 107° C., and accordingly, the output voltage of the R-side end portion thermistor 86*a* (see line L31 in FIG. 7B) increases to about 2.67 V.

On the other hand, the detected temperature of the F-side end portion thermistor 86*b* is maintained at about 152° C. to 153° C. The output voltage of the F-side end portion thermistor 86*b* (see line L32 in FIG. 7B) is about 1.82 V to 1.84 V and is maintained generally equal to the level reached before occurrence of the breakage of the heating belt 83. Therefore, there is a large difference between the output voltage of the R-side end portion thermistor 86*a* (see line L31 in FIG. 7B) and the output voltage of the F-side end portion thermistor 86*b* (see line L32 in FIG. 7B). Accordingly, the comparator 109 makes the ON determination, and the wired OR circuit stops outputting a rotation pulse. As a result, the signal transmitted from the wired OR circuit 88 changes from the rotation pulse signal to the low level signal, and supply of the heater REM signal to the heat source 85 stops.

The above-described abnormality detection method and abnormality detection device for the image forming apparatus 1 and the above-described image forming apparatus 1 according to the present embodiment provide the following effects.

In the abnormality detection device of the image forming apparatus 1 according to the present embodiment, the respective detected temperatures of the R-side end portion thermistor 86*a* and the F-side end portion thermistor 86*b* are maintained at generally the same level in a normal state. In the abnormality detection device of the image forming apparatus 1 according to the present embodiment, breakage or positional deviation in the heating belt 83 is detected by determining whether or not the difference between the detected temperature of the R-side end portion thermistor 86*a* and the detected temperature of the F-side end portion thermistor 86*b* is greater than a predetermined value. This enables detection of breakage or positional deviation in the heating belt 83 without monitoring the heating belt 83 for a long period of time. Further, heating by the heat source 85 can be quickly stopped after breakage of the heating belt 83, and therefore, the safety of the image forming apparatus 1 can be improved. Further, even when the temperature of the heating belt 83 is low, breakage or positional deviation in the heating belt 83 can be detected.

The image forming apparatus 1 of the present embodiment includes the heating belt 83 that is looped around the heating roller 81 and the fixing roller 82. The abnormality detection device of the image forming apparatus 1 according to the present embodiment includes the R-side end portion thermistor 86*a* for detecting the temperature of one widthwise end portion (end portion 83*a*) of the heating belt 83, the F-side end portion thermistor 86*b* for detecting the temperature of the other widthwise end portion (end portion 83*b*) of the heating belt 83, the temperature difference detection circuit 87*a* (temperature difference detection section) for determining whether or not the temperature difference between the temperature of the one end portion (end portion 83*a*) which is detected by the R-side end portion thermistor 86*a* and the temperature of the other end portion (end portion 83*b*) which is detected by the F-side end portion thermistor 86*b* is greater than a predetermined value, and the engine CPU 90 (judgment section) for judging that an abnormality (particularly, breakage or positional deviation) has occurred in the heating belt 83 when it is determined in the temperature difference detection circuit 87*a* that the temperature difference between the end portions 83*a*, 83*b* (both widthwise end portions of the heating belt 83) is greater than a predetermined value.

In the abnormality detection device of the image forming apparatus 1 according to the present embodiment, the temperature difference detection circuit 87*a* includes the first differential amplifier circuit (operational amplifier 99 and resistance elements 100 to 103) for detecting a temperature difference (first temperature difference) which is obtained by subtracting the temperature of the other widthwise end portion (end portion 83*b*) of the heating belt 83 from the temperature of the one widthwise end portion (end portion 83*a*), the first comparator (comparator 109) for determining whether or not the temperature difference detected by the first differential amplifier circuit is greater than a predetermined value, the second differential amplifier circuit (operational amplifier 104 and resistance elements 105 to 108) for detecting a temperature difference (second temperature difference) which is obtained by subtracting the temperature of the one end portion (end portion 83*a*) from the temperature of the other end portion (end portion 83*b*), the second comparator (comparator 112) for determining whether or not the temperature difference detected by the second differential amplifier circuit is greater than a predetermined value, and a temperature difference determination section (comparators 109, 112, rotation pulse generation circuit 115, resistance element 116) for determining that the temperature difference between the end portions 83*a*, 83*b* (both widthwise end portions of the heating belt 83) is greater than a predetermined value when it is determined in at least one of the first comparator (comparator 109) and the second comparator (comparator 112) that the temperature difference is greater than the predetermined value.

Note that, in the above-described embodiment, the temperature of the heating belt 83 is detected by the R-side end portion thermistor 86*a* and the F-side end portion thermistor 86*b*. However, the number of thermistors is not limited to two but may be arbitrary. For example, another thermistor may be provided between the R-side end portion thermistor 86*a* and the F-side end portion thermistor 86*b* for detecting the temperature of a central portion of the heating belt 83. So long as the abnormality detection device of the image forming apparatus 1 includes temperature detection devices (e.g., thermistors) for detecting at least the respective temperatures of one widthwise end portion (e.g., R-side end portion) and the other widthwise end portion (e.g., F-side end portion) of the heating belt 83, the temperature difference between the end portions 83*a*, 83*b* (both widthwise end portions of the heating belt 83) can be obtained.

In the above-described embodiment, thermistors (R-side end portion thermistor 86*a* and F-side end portion thermistor 86*b*) whose output voltages increase as the detected temperatures decrease are used. However, the present disclosure is not limited to this example. Thermistors whose output voltages decrease as the detected temperatures decrease may be used.

The configuration and operation of the above-described embodiment are merely exemplary and may be suitably modified without departing from the spirit of the present disclosure.

What is claimed is:

1. An abnormality detection method for detecting an abnormality in an image forming apparatus, comprising:

a providing step of providing an image forming apparatus including a heating roller, a fixing roller, and a heating belt looped around the heating roller and the fixing roller;

a temperature detection step of detecting temperatures of one widthwise end portion and the other widthwise end portion of the heating belt using thermistors;

a temperature difference detection step of determining whether or not a temperature difference between the temperature of the one end portion and the temperature of the other end portion which are detected in the temperature detection step is greater than a predetermined value; and a judgment step of judging that an abnormality has occurred in the image forming apparatus when it is determined in the temperature difference detection step that the temperature difference is greater than the predetermined value, wherein in the temperature difference detection step, when it is determined that the temperature difference is smaller than the predetermined value, a pulse signal is output, and the method further comprises a controlling step of controlling upon receipt of the pulse signal, a heat source that heats the heating belt.

2. A method according to claim 1, wherein the temperature difference detection step includes a first temperature difference detection step of detecting a first temperature difference using a first differential amplifier circuit, the first temperature difference being obtained by subtracting the temperature of the other end portion from the temperature of the one end portion, a first temperature difference determination step of determining whether or not the first temperature difference is greater than a first predetermined value using a first comparator, a second temperature difference detection step of detecting a second temperature difference using a second differential amplifier circuit, the second temperature difference being obtained by subtracting the temperature of the one end portion from the temperature of the other end portion, a second temperature difference determination step of determining whether or not the second temperature difference is greater than a second predetermined value using a second comparator, and a temperature difference determination step of determining that the temperature difference is greater than the predetermined value when it is determined in at least one of the first temperature difference determination step and the second temperature difference determination step that the temperature difference is greater than the predetermined value.

3. A method according to claim 1, wherein when it is determined in the temperature difference detection step that the temperature difference is greater than the predetermined value, it is judged in the judgment step that breakage or positional deviation has occurred in the heating belt.

4. A method according to claim 1, further comprising:

a step of determining whether or not the temperature of the one end portion detected by one of the thermistors has reached a first predetermined temperature, outputting a first-level signal during a normal operation of a fixing device that includes the heating roller, the fixing roller, the heating belt, and the heat source, and outputting a second-level signal different from the first-level signal upon detection of an abnormality in the fixing device;

a step of determining whether or not the temperature of the other end portion detected by the other of the thermistors has reached a second predetermined temperature, outputting a third-level signal during the normal operation of the fixing device, and outputting a fourth-level signal different from the third-level signal upon detection of an abnormality in the fixing device; and a step of outputting a signal for controlling the heat source to the heat source when the first-level signal, the third-level signal, and the pulse signal are output, wherein in the temperature difference detection step, when it is determined that the temperature difference is greater than the predetermined value, a constant-level signal is output, the method further comprises a step of suspending output of the signal for controlling the heat source to the heat source when any of the second-level signal, the fourth-level signal, and the constant-level signal is output.

5. A method according to claim 1, wherein the heat source is disposed around the heating roller with a space between the heat source and the heating roller, and the method further comprises a step of performing induction heating by the heat source on the heating roller and the heating belt.

6. An abnormality detection device for detecting an abnormality in an image forming apparatus which includes a heating belt looped around a heating roller and a fixing roller, the device comprising:

thermistors for detecting temperatures of one widthwise end portion and the other widthwise end portion of the heating belt;

a temperature difference detection section for determining whether or not a temperature difference between the temperature of the one end portion and the temperature of the other end portion which are detected by the thermistors is greater than a predetermined value; and a judgment section for judging that an abnormality has occurred in the image forming apparatus when it is determined in the temperature difference detection section that the temperature difference is greater than the predetermined value, wherein the temperature difference detection section includes a first differential amplifier circuit for detecting a first temperature difference, the first temperature difference being obtained by subtracting the temperature of the other end portion from the temperature of the one end portion, a first comparator for determining whether or not the first temperature difference is greater than a first predetermined value, a second differential amplifier circuit for detecting a second temperature difference, the second temperature difference being obtained by subtracting the temperature of the one end portion from the temperature of the other end portion, a second comparator for determining whether or not the second temperature difference is greater than a second predetermined value, and a temperature difference determination section for determining that the temperature difference is greater than the predetermined value when it is determined in at least one of the first comparator and the second comparator that the temperature difference is greater than the predetermined value, the temperature difference determination section includes a pulse generation circuit for generating a pulse signal, when it is determined that the first temperature difference is smaller than the first predetermined value and the second temperature difference is smaller than the second predetermined value, the temperature difference determination section outputs the pulse signal to the judgement section, and upon receipt of the pulse signal, a heat source that heats the heating belt is controlled.

7. An abnormality detection device according to claim 6, wherein when it is determined in the temperature difference detection section that the temperature difference is greater than the predetermined value, the judgment section judges that breakage or positional deviation has occurred in the heating belt.

8. An abnormality detection device according to claim 6, further comprising:

a first high temperature detection circuit for determining whether or not the temperature of the one end portion detected by one of the thermistors has reached a first predetermined temperature, outputting a first-level signal during a normal operation of a fixing device that includes the heating roller, the fixing roller, the heating belt, and the heat source, and outputting a second-level signal different from the first-level signal upon detection of an abnormality in the fixing device;

a second high temperature detection circuit for determining whether or not the temperature of the other end portion detected by the other of the thermistors has reached a second predetermined temperature, outputting a third-level signal during the normal operation of the fixing device, and outputting a fourth-level signal different from the third-level signal upon detection of an abnormality in the fixing device; and a circuit for outputting a signal for controlling the heat source to the heat source when the first high temperature detection circuit, the second high temperature detection circuit, and the temperature difference determination section output the first-level signal, the third-level signal, and the pulse signal, respectively, wherein when it is determined that the first temperature difference is greater than the first predetermined value or the second temperature difference is greater than the second predetermined value, the temperature difference determination section outputs a constant-level signal to the judgement section, and the circuit suspends output of the signal for controlling the heat source to the heat source upon the first high temperature detection circuit outputting the second-level signal, the second high temperature detection circuit outputting the fourth-level signal, or the temperature difference determination section outputting the constant-level signal.

9. An abnormality detection device according to claim 6, wherein the heat source is disposed around the heating roller with a space between the heat source and the heating roller, and the heat source performs induction heating on the heating roller and the heating belt.

10. An image forming apparatus, comprising a heating roller;

a fixing roller;

a heating belt looped around the heating roller and the fixing roller;

a heat source for heating the heating belt; and an abnormality detection device for detecting an abnormality of the heating belt, wherein the abnormality detection device includes:

thermistors for detecting temperatures of one widthwise end portion and the other widthwise end portion of the heating belt;

a temperature difference detection section for determining whether or not a temperature difference between the temperature of the one end portion and the temperature of the other end portion which are detected by the thermistors is greater than a predetermined value; and a judgment section for judging that an abnormality has occurred in the heating belt when it is determined in the temperature difference detection section that the temperature difference is greater than the predetermined value, the temperature different detection section includes a pulse generation circuit for generating a pulse signal, upon determining that the temperature difference is smaller than the predetermined value, the temperature difference detection section outputs the pulse signal to the judgement section, and upon receipt of the pulse signal, the heat source is controlled.

11. An image forming apparatus according to claim 10, wherein the temperature difference detection section includes a first differential amplifier circuit for detecting a first temperature difference, the first temperature difference being obtained by subtracting the temperature of the other end portion from the temperature of the one end portion, a first comparator for determining whether or not the first temperature difference is greater than a first predetermined value, a second differential amplifier circuit for detecting a second temperature difference, the second temperature difference being obtained by subtracting the temperature of the one end portion from the temperature of the other end portion, a second comparator for determining whether or not the second temperature difference is greater than a second predetermined value, and a temperature difference determination section for determining that the temperature difference is greater than the predetermined value when it is determined in at least one of the first comparator and the second comparator that the temperature difference is greater than the predetermined value.

12. An image forming apparatus according to claim 10, wherein when it is determined in the temperature difference detection section that the temperature difference is greater than the predetermined value, the judgment section judges that breakage or positional deviation has occurred in the heating belt.

13. An image forming apparatus according to claim 10, wherein the abnormality detection device further includes:

a first high temperature detection circuit for determining whether or not the temperature of the one end portion detected by one of the thermistors has reached a first predetermined temperature, outputting a first-level signal during a normal operation of a fixing device that includes the heating roller, the fixing roller, the heating belt, and the heat source, and outputting a second-level signal different from the first-level signal upon detection of an abnormality in the fixing device;

a second high temperature detection circuit for determining whether or not the temperature of the other end portion detected by the other of the thermistors has reached a second predetermined temperature, outputting a third-level signal during the normal operation of the fixing device, and outputting a fourth-level signal different from the third-level signal upon detection of an abnormality in the fixing device; and a circuit for outputting a signal for controlling the heat source to the heat source when the first high temperature detection circuit, the second high temperature circuit, and the temperature difference detection section output the first-level signal, the third-level signal, and the pulse signal, respectively, when it is determined that the temperature difference is greater than the predetermined value, the temperature difference detection section outputs a constant-level signal to the judgement section, and the circuit suspends output of the signal for controlling the heat source to the heat source upon the first high temperature detection circuit outputting the second-level signal, the second high temperature detection circuit outputting the fourth-level signal, or the temperature difference detection section outputting the constant-level signal.

14. An image forming apparatus according to claim 10, wherein the heat source is disposed around the heating roller with a space between the heat source and the heating roller, and the heat source performs induction heating on the heating roller and the heating belt.

* * * * *